US006060128A

United States Patent [19]

Kim et al.

[11] Patent Number: 6,060,128

[45] Date of Patent: May 9, 2000

[54] METHOD OF PRODUCING THIN FILM AND NANOPARTICLE DEPOSITS USING CHARGES OF ALTERNATING POLARITY

[75] Inventors: Kyekyoon Kim, Urbana; Qichen Feng, Champaign, both of Ill.

[73] Assignee: The Board of Trustees of the University of Illinois, Urbana, Ill.

[21] Appl. No.: 09/281,144

[22] Filed: Mar. 29, 1999

Related U.S. Application Data

[63] Continuation of application No. 08/823,724, Mar. 25, 1997, Pat. No. 5,948,483.

[51] Int. Cl.[7] ..... B05D 1/04

[52] U.S. Cl. ..... 427/483; 427/421

[58] Field of Search ..... 361/228; 427/483, 427/421; 239/3

[56] References Cited

U.S. PATENT DOCUMENTS

| | | |
|---|---|---|
| 1,958,406 | 5/1934 | Darrah . |
| 3,717,875 | 2/1973 | Arciprete et al. . |
| 4,264,641 | 4/1981 | Mahoney et al. . |
| 4,280,130 | 7/1981 | Slemmons . |
| 4,476,515 | 10/1984 | Coffee . |
| 4,549,243 | 10/1985 | Owen et al. . |
| 4,574,092 | 3/1986 | Gourdine . |
| 4,748,043 | 5/1988 | Seaver et al. . |
| 4,762,553 | 8/1988 | Savage et al. . |
| 4,762,975 | 8/1988 | Mahoney et al. . |
| 4,925,699 | 5/1990 | Fagan . |
| 4,929,400 | 5/1990 | Rembaum et al. . |
| 4,993,361 | 2/1991 | Unvala . |
| 5,115,971 | 5/1992 | Greenspan et al. . |
| 5,222,663 | 6/1993 | Noakes et al. . |
| 5,229,171 | 7/1993 | Donovan et al. . |
| 5,344,676 | 9/1994 | Kim et al. . |
| 5,514,423 | 5/1996 | Krish et al. . |

FOREIGN PATENT DOCUMENTS 568466 11/1977 U.S.S.R. .

OTHER PUBLICATIONS

Woosley, J. et al., "Field injection electrosttaic spraying of liquid hydrogen," J. Appl. Phys., vol. 64, No. 9 (Nov. 1988) pp. 4278–4284.

Woosley, J. et al., "Electrostatic Spraying of Insulating Lquids: $H_2$", IEEE Trans. Ind. Appl., vol. IA–18, No. 3 (May/Jun. 1982) pp. 314–320.

Kim, K. et al., "Generation of charged drops of insulating liquids by electrostatic spraying," J. Appl. Phys., vol. 47, No. 5 (May 1976) pp. 1964–1969.

*Primary Examiner*—Fred J. Parker

*Attorney, Agent, or Firm*—Marshall, O'Toole, Gerstein, Murray & Borun

[57] ABSTRACT

A method for producing a thin film or nanoparticle deposit includes the step of providing a working liquid, movement of the working liquid at a liquid surface prevented by surface tension. The method also includes the steps of supplying an electric charge having a first polarity to the working liquid at the liquid surface to overcome surface tension at the liquid surface to produce a first plurality of charged nanodrops and directing the first plurality of charged nanodrops against a substrate surface. The method further includes the steps of supplying an electric charge having a second polarity to the working liquid at the liquid surface, the second polarity being opposite to the first polarity, to overcome surface tension at the liquid surface to produce a second plurality of charged nanodrops, and directing the second plurality of charged nanodrops against the substrate surface. The method additionally includes the step of alternating between supplying the electric charge having the first polarity and supplying the electric charge having the second polarity to the working liquid at the liquid surface. An apparatus for producing a thin film or nanoparticle deposit includes an apparatus for supplying a working liquid, surface tension preventing movement of the working liquid from the apparatus for supplying a working fluid at a liquid surface, an apparatus for supplying an electric charge to the working liquid at the liquid surface to overcome the surface tension to produce a stream of nanodrops, and an apparatus for supplying electric charge of alternating polarity to the apparatus for supplying the electric charge to the working liquid at the liquid surface.

3 Claims, 2 Drawing Sheets

METHOD OF PRODUCING THIN FILM AND NANOPARTICLE DEPOSITS USING CHARGES OF ALTERNATING POLARITY

CROSS-REFERENCE TO RELATED APPLICATIONS

This application is a continuation of Ser. No. 08/823,724, Mar. 25, 1997 U.S. Pat. No. 5,948,483.

STATEMENT REGARDING FEDERALLY SPONSORED RESEARCH/DEVELOPMENT

Not applicable.

BACKGROUND OF THE INVENTION

1. Technical Field

This invention relates to methods and apparatuses for producing thin films and nanoparticles deposits, and in particular, for producing thin films and nanoparticle deposits by electrostatic spraying of nanodrops.

2. Background Art

Electrostatic spraying apparatuses are known in the art. See U.S. Pat. No. 5,344,676, the disclosure of which is incorporated herein by reference. In an electrostatic spraying apparatus, electric charge is supplied to a surface of a liquid. When the repulsive forces within the liquid caused by the electric charge exceed the surface tension maintaining the surface of the liquid, the surface of the liquid is explosively disrupted to form small jets. The small jets break up into streams of charged liquid clusters referred to as nanodrops (liquid phase) or nanoparticles (solid phase formed by solidifying nanodrops).

The resulting stream of nanodrops can then be directed onto a surface of a target material or substrate. Over time, the nanodrops will collect on the surface of the target material to form a thin film on the surface.

This electrostatic method, while an improvement over other conventional methods of thin film fabrication, such as chemical vapor deposition, sputtering, laser ablation, and spray pyrolysis, may have significant disadvantages. For one thing, the explosive disruption of the surface of the liquid forms nanodrops which are small, but which may move at high velocities. As a consequence, when the nanodrops collide with the target material, a great deal of momentum may be transferred from the nanodrops to the target material. Where the target material is being suspended, for example by use of acoustical pressure fields, the transfer of momentum from the nanodrops to the target material may force the target material out of alignment with the supporting fields.

Furthermore, as nanodrops collect on the surface of an electrically insulated target material, a space charge problem may occur. Because the electrically insulated target material cannot efficiently transport charge away from the surface, certain areas of the surface may assume the charge of the nanodrops which have been applied to the surface. As a consequence, the charged surface may affect the further application of nanodrops to the surface. As a further consequence, a non-uniform film may result on the surface.

BRIEF SUMMARY OF THE INVENTION

This invention is directed to overcoming one or more of the foregoing problems.

Therefore, in an embodiment of the present invention, a method for producing a thin film or nanoparticle deposit includes the step of providing a working liquid, movement of the working liquid at a liquid surface prevented by surface tension. The method also includes the steps of supplying an electric charge having a first polarity to the working liquid at the liquid surface to overcome surface tension at the liquid surface to produce a first plurality of charged nanodrops and directing the first plurality of charged nanodrops against a substrate surface. The method further includes the steps of supplying an electric charge having a second polarity to the working liquid at the liquid surface, the second polarity being opposite to the first polarity, to overcome surface tension at the liquid surface to produce a second plurality of charged nanodrops, and directing the second plurality of charged nanodrops against the substrate surface. The method additionally includes the step of alternating between supplying the electric charge having the first polarity and supplying the electric charge having the second polarity to the working liquid at the liquid surface.

Moreover, the step of supplying the electric charge having the first polarity to the working liquid may include the steps of providing an electrode disposed within the working liquid adjacent to the liquid surface, and supplying a charge having a first polarity to the electrode.

Moreover, the step of supplying the electric charge having the second polarity to the working liquid may include the steps of providing an electrode disposed within the working liquid adjacent to the liquid surface, and supplying a charge having a second polarity to the electrode.

Moreover, the electric charge having the first polarity may be supplied to the working liquid over a first time period, and the electric charge having the second polarity may be supplied to the working liquid over a second time period. The first and second time periods may be of equal length.

Moreover, the method may include the steps of applying an electric field to the first plurality of charged nanodrops directed against the substrate surface, and applying the electric field to the second plurality of charged nanodrops directed against the substrate surface. The method may also include alternating the polarity of the electric field between first and second opposite polarities. Additionally, the electric charge may be alternated between the first and second polarities, and the electric field may be alternated between the first and second polarities so that the polarity of the electric field and the polarity of the electric charge are opposite.

In a further embodiment of the present invention, an apparatus for producing a thin film or nanoparticle deposit includes an apparatus for supplying a working liquid, surface tension preventing movement of the working liquid from the apparatus for supplying a working fluid at a liquid surface, an apparatus for supplying an electric charge to the working liquid at the liquid surface to overcome the surface tension to produce a stream of nanodrops, and an apparatus for supplying electric charge of alternating polarity to the apparatus for supplying the electric charge to the working liquid at the liquid surface.

Moreover, the apparatus for supplying a working liquid may include a tube having a first open end, the liquid surface disposed at the first open end, the apparatus for supplying an electric charge to the working liquid may include an electrode disposed within the tube, and the apparatus for supplying electric charge of alternating polarity to the apparatus for supplying the electric charge to the working liquid may include a dual polarity voltage generator connected to the electrode.

Moreover, the apparatus for producing a thin film may include an apparatus for generating an electric field which is applied to the stream of nanodrops. Additionally, the apparatus for generating the electric field may include a set of electrodes disposed remotely from the first electrode, and a dual polarity voltage generator connected to the set of electrodes which supplies the set of electrodes with a voltage signal of alternating polarity.

In a still further embodiment of the invention, an apparatus for producing a thin film or nanoparticle deposit includes a supply vessel for receiving a working liquid and a tube with one end in communication with the supply vessel and the other end being open. An electrode is positioned within the tube and having a point extending beyond the open end, the tube and the electrode having dimensions and being positioned such that surface tension of a working liquid disposed between the tube and the electrode prevents the working liquid from flowing out of the open end. A dual polarity charge generator is connected to the electrode, the generator providing a series of charge pulses of alternating polarity to the electrode, the charge pulses causing mutually repulsive forces within a working liquid disposed between the tube and the electrode to overcome the surface tension of the working liquid to produce liquid jets of alternating polarity which break up into nanodrops of alternating polarity.

Moreover, the apparatus for producing a thin film according to the still further embodiment of the invention may include a set of electrodes disposed remotely from the first electrode, and a voltage generator connected to the set of electrodes, the set of electrodes producing an electric field which is applied to the nanodrops of alternating polarity.

BRIEF DESCRIPTION OF THE SEVERAL VIEW OF THE DRAWINGS

DETAILED DESCRIPTION OF THE INVENTION

Figure 1:
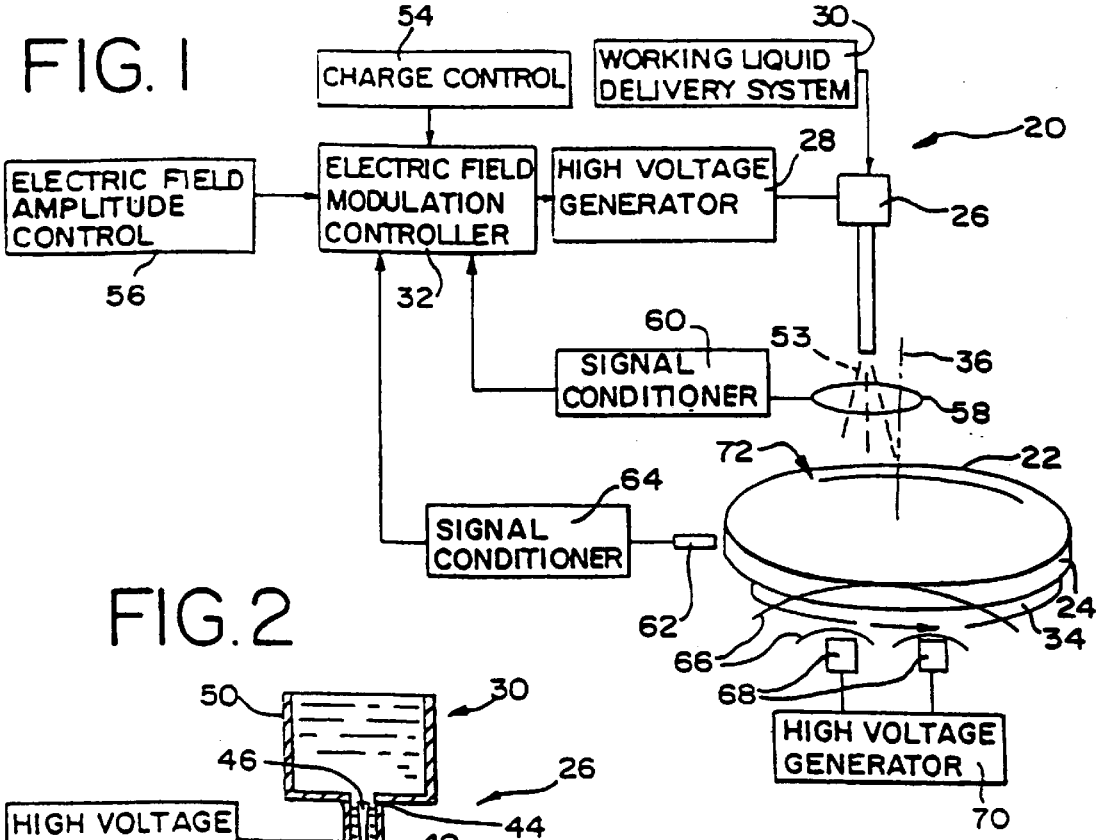
FIG. 1 is a schematic diagram of an embodiment of the present invention for producing a thin film or nanoparticle deposit on a target material or substrate.

An embodiment of the present invention of a system 20 for producing a thin film 22 on a substrate 24 is shown schematically in FIG. 1. The system 20 includes an electrostatic applicator 26, a dual polarity or alternating current high voltage generator 28, a working liquid delivery system 30, and an electric field modulation controller or control module 32.

The substrate 24 is supported on a table 34, which revolves the substrate 24 about a central axis 36. Alternatively, the system 20 can be used with a stationary substrate, or a substrate which is moved in a rectilinear fashion, rather than in a rotational direction.

The electrostatic applicator 26 is disposed above the substrate 24 and rotating table 34 at an offset to the central axis 36 of the table 34 and substrate 24. As a consequence, as the table 34 and substrate 24 rotate, the applicator 26 will be disposed above a different sector of the substrate 24.

Figure 2:
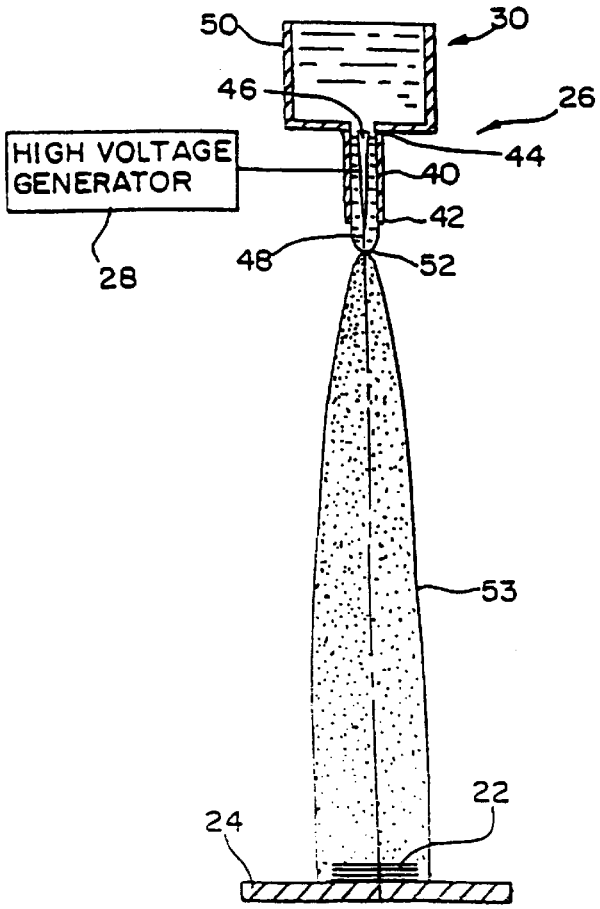
FIG. 2 is a cross-sectional view of an electrostatic applicator for use with the embodiment of the present invention of FIG. 1.

The electrostatic applicator 26 is shown in greater detail in FIG. 2. The electrostatic applicator 26 includes a downwardly depending, electrically insulating capillary tube 40, with an open lower end 42 and an open upper end 44. While the tube 40 is shown with a vertical orientation, the tube 40 may be aligned with the horizontal, or aligned at an angle to the horizontal (see FIG. 6).

Within the tube 40 is a solid conductive needle electrode 46. The needle 46 has a sharp point 48 at one end. The needle 46 is disposed in the tube 40 such that the point 48 of the needle 46 extends beyond the open lower end 42 of the tube 40. A suitable needle 46 for use in the electrostatic applicator 26 is fabricated from tungsten using an electrochemical etching process.

The electrostatic applicator 26 is attached to a working liquid delivery system 30 at the upper end 44 of the tube 40. The working liquid delivery system 30 includes a supply vessel 50 which contains a supply of a working liquid prepared by dissolving a suitable base compound in a suitable solvent. The base compounds and solvents are selected according to the desired composition of the thin film product or nanoparticle deposit to be formed. Some examples of suitable working liquids, base compounds and solvents are provided in U.S. Pat. No. 5,344,676, Table 1. Specifically, if the composition of the thin film to be formed is ZnO, a compound frequently used in piezoelectric and semiconductor thin films, then a suitable working liquid may consist of Zn-trifluoroacetate dissolved in methanol.

As described in U.S. Pat. No. 5,344,676, when the product includes a number of base compounds or results from the chemical reaction of two or more base compounds, several intermediate liquids may be prepared using the desired base compounds and suitable solvents. The working liquid can then be prepared by mixing the intermediate liquids in suitable proportions.

The supply vessel 50 is shown connected to the tube 40 in a vertical orientation to eliminate some differential gravitational effects on the process and to provide a smooth liquid flow to the electrostatic applicator 26 under the influence of gravity. Alternatively, the supply vessel 50 and the tube 40 may instead be disposed at an angle to the horizontal, or along the horizontal. If the supply vessel 50 and tube 40 are oriented in other than a vertical direction, it may be necessary to provide a suitable apparatus for forcing the working liquid out of the supply vessel 50 and through the tube 40. For example, a pressurized gas supply or a syringe pump may be connected to the supply vessel 50 to force the working liquid out of the vessel 50 and the tube 40 under the influence of a stream of pressurized gas.

As shown in FIG. 2, the supply vessel 50 is formed integrally with the tube 40. The integrally formed vessel 50 and tube 40 may be used where the non-reactivity of the working liquid with the vessel 50 and the tube 40 is the primary concern. A suitable material, such as glass, can be used to form the vessel 50 and the tube 40. Alternatively, where the working liquid may need to be stored in the working liquid delivery system 30 at a specific temperature and/or pressure prior to delivery to the electrostatic applicator 26, the supply vessel 50 and the tube 40 may be formed separately, so that a material can be selected to form the supply vessel 50 which is resistant to the temperatures and/or pressures at which the working liquid must be stored.

Figure 3:
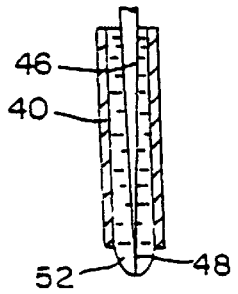
FIG. 3 is an enlarged, fragmentary, cross-sectional view of the electrostatic applicator illustrated in FIG. 2.

When the needle 46 is at least electrically neutral, the working liquid in the tube 40, and in particular at the lower end 42, is preferably prevented from flowing out of the tube 40 by the surface tension of the liquid in tube 40, except for a small amount which forms a hemispherical surface 52 surrounding the point 48 (FIG. 3). To ensure that suitable surface tension is maintained, one of ordinary skill in the art will realize that it will be necessary to consider the interior diameter of the tube 40, the diameter of the needle 46, the radius at the needle point 48, and the distance the needle point 48 extends beyond the lower end 42 of the tube 40. By way of example, the tube interior diameter should be 300–400 microns or larger, the needle diameter should be less than half the tube interior diameter up to approximately five microns from the point 48, the needle point diameter should be less than approximately five microns, and the needle extension beyond the lower end 42 of the tube 40 should be no more than 200–300 microns.

The electrostatic applicator 26 is also connected to the high voltage generator 28. Specifically, the high voltage generator 28 is connected to the needle 46. Activation of the generator 28 causes charge to be injected via needle 46 directly into the working liquid, particularly in the small hemispherical surface 52 of liquid surrounding the point 48. The charge injection mechanism is either field emission if the polarity of the needle 46 is negative, or field ionization if the polarity is positive.

The injection of charge into the small hemispherical surface 52 causes repulsive electric forces within the liquid to overcome the surface tension, resulting in explosive disruption of the hemispherical surface 52. The explosive disruption of the surface 52 forms small jets of liquid, which break up into a stream 53 of charged nanodrops.

Figure 4:
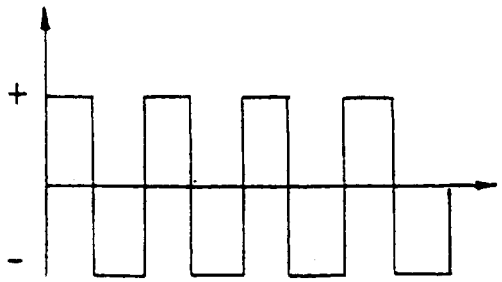
FIG. 4 is a timing diagram showing the variation in electric field used to provide a neutrally charged thin film or nanoparticle deposit.
Figure 5:
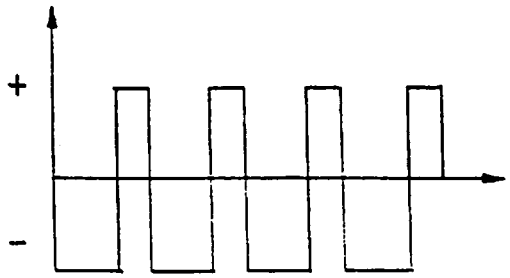
FIG. 5 is a timing diagram showing the variation in electric field used to provide a more negatively than positively charged film or nanoparticle deposit.

The high voltage generator 28 may provide a time-variable voltage signal to the needle 46, such as is shown in FIGS. 4 and 5. Preferably, the high voltage generator 28 provides a time-variable voltage signal which is a train of pulses. The high voltage generator 28 may be modulated by the control module 32 to allow for variation of the polarity and the width of each pulse in the train of pulses. By varying the width and the polarity of the pulses of the voltage signal provided to needle 46, it may be possible to control the uniformity of the film 22 and the momentum of the nanodrops produced when the charge is injected into the liquid.

For example, if the polarity of the pulses is varied in the fashion shown in FIG. 4, the nanodrops of the stream 53 formed at the open end 42 of the needle 40 will alternatively be of positive and negative polarity. Moreover, because the pulses of the voltage signal applied to the needle 46 are of equal width, the numbers of nanodrops of negative and positive polarity will be of substantially equal number. (By contrast, as shown in FIG. 5, where the negative polarity pulses are of greater width or duration, more negatively charged nanodrops than positively charged nanodrops will be produced.)

As a consequence of the signal shown in FIG. 4, if the stream 53 of resultant nanodrops is directed against an electrically insulated surface, the net polarity of the surface should remain substantially neutral. Therefore, the stream 53 of nanodrops should not be repulsed by the charge of the nanodrops already applied to the surface of the substrate 24. Consequently, a space charge problem should not develop, and the film 22 formed should be of substantially uniform thickness.

As a further consequence of the use of an alternating polarity voltage signal, the alternating electric field created by applying pulses of varying polarity to the needle 46 allows the velocity, and hence the momentum, of the nanodrops to be controlled. In theory, alternating the polarity of the electric field could be used to reduce the velocity of the nanodrops to near zero at the surface of the target material or substrate 24.

To further illustrate the manner in which the momentum of the nanodrops can be controlled, it can be shown that the velocity of a nanodrop in the stream 53 of nanodrops directed at the surface of the substrate 24 may be expressed as:

$$v(t) = \int_0^t qE(t)\,dt \qquad \text{(Eqn. 1)}$$

where v(t) is the velocity of a nanodrop as a function of time;

q is the specific charge (charge per unit mass) of the nanodrop; and

E(t) is the electric field acting on the nanodrop.

In particular:

$$E(t)=E_0 e^{-n\sigma}\, sign(\sin \omega t) \qquad \text{(Eqn. 2)}$$

where $E_0$ is the electric field intensity at the point 48 of the electrode 46;

n is ordinal number of the pulses within the voltage signal;

σ is the attenuation coefficient;

sign(x) is −1 if x is negative and +1 if x is positive; and

ω is the angular frequency of the voltage source.

Substituting Eqn. 2 into Eqn. 1 and integrating over time (from t=0 to t=NT/2+Δt) yields:

$$v(t) = qE_0\left[\sum_{n=0}^{N} \frac{T}{2}(-1)^n e^{-n\sigma} + \Delta t(-1)^{N+1} e^{-(N+1)\sigma}\right] \qquad \text{(Eqn. 3)}$$

where T is the time period of the voltage signal, and 0<Δt<T.

Thus, it will be noted that the velocity of the nanodrop is directly related to the specific charge (q) of the nanodrop, the strength of the electric field ($E_0$) applied to the nanodrop, and the period (T) of the dual polarity voltage signal. When q and $E_0$ are chosen as constants, it could be said that the velocity of the nanodrop is inversely related to the frequency of the dual polarity voltage signal. Hence, a dual polarity voltage signal having a relatively small period (or high frequency) should produce nanodrops with a relatively low velocity and momentum.

As described above, variation of the voltage signal produced by the dual polarity high voltage generator 28 is achieved via the control module 32. The control module 32 is in turn connected to a charge control 54, an electric field amplitude control 56, a charge sensor 58 (with accompanying signal conditioner 60) and a position sensor 62 (with accompanying signal conditioner 64). Via the charge control 54 and the amplitude control 56, the operator can vary the width and amplitude of the pulses in the voltage signal provided by the voltage generator 28 so as to modify the net polarity of the resulting film 22 and the size of the nanodrops being generated by the electrostatic applicator 26.

The charge sensor 58 and position sensor 62 allow for the closed loop position control of the generation of the nanodrops during the rotation of the substrate 24. For example, whenever the nanodrops are charged more positively or more negatively than neutrality, a portion of the charged drops will deposit on the charge sensor 58. The sensor 58 will feed back the charge signal to the control module 32, which will cause the control module 32 to adjust the width of the high voltage pulses. Preferably, the adjustment occurs instantaneously. In this manner, the neutrality of film deposition can be automatically controlled.

As a further modification of this embodiment of the present invention, a retardation electric field 66 could be set up by positioning a further set of electrodes 68 connected to a second dual polarity voltage generator 70 on the side of the substrate 24 opposite the electrostatic applicator 26. The phase and polarity of the retardation electric field 66 could then be varied by varying the voltage signal generated by the voltage generator 70, for example, to aid in controlling of the velocity and momentum of the nanodrops generated by the electrostatic applicator 26. The velocity and momentum of the nanodrops could be varied, for example, by providing a dual polarity electric field 66 which is opposite in polarity to the electric field generated at the needle 46.

Alternatively, the electrodes 68 could be arranged in a pattern on the side of the substrate 24 opposite the electrostatic applicator 26 to control the application of the thin film 22 upon the substrate 24. For example, the introduction of a strong varying-polarity, electric field 66 of polarity opposite to the polarity of the electric charge of the nanodrops leaving the electrostatic applicator 26 could direct the nanodrops so that the nanodrops are applied only to predetermined areas 72 of the substrate 24.

Figure 6:
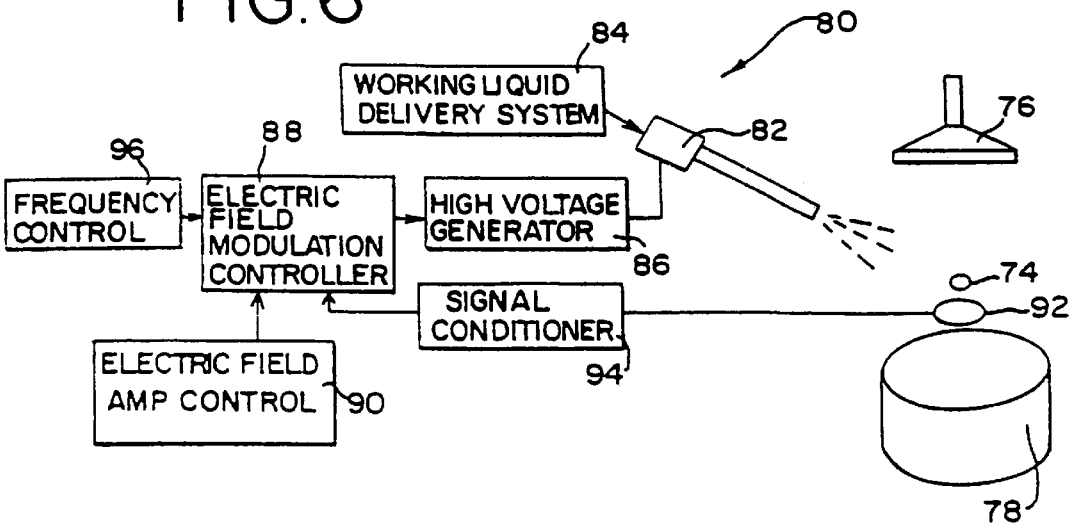
FIG. 6 is a schematic diagram of a further embodiment of the present invention for producing a thin film or nanoparticle deposit on a target material or substrate undergoing levitation.

FIG. 6 shows a further alternative embodiment of the present invention, wherein the target material 74 is levitated between an acoustical levitator 76 and an acoustical reflector 78. In this embodiment of the invention, the system 80 includes the electrostatic applicator 82, working liquid delivery system 84, high voltage generator 86, an electric field modulation controller or control module 88, electric field amplitude control 90 and charge sensor 92 (with accompanying signal conditioner 94). These items function as explained above with respect to the embodiment of the invention shown in FIG. 1.

It should be noted that this embodiment of the invention still allows for the operator to select the amplitude of the electric field to control the size of the resultant nanodrops and to control the polarity of the resultant film 22. In the embodiment shown in FIG. 6, it is critical to control the momentum at which the nanodrops collide with the target material 74 so as to prevent the target material 74 from moving out of alignment with the acoustical pressure fields that maintain the target material 74 in a levitated condition. Therefore, a frequency control 96 is provided, by which the operator may increase the frequency of the applied voltage signal so as to lower the momentum of the resultant nanodrops.

Still other aspects, objects, and advantages of the present invention can be obtained from a study of the specification, the drawings, and the appended claims.

What is claimed is:

1. A method for producing a thin film or nanoparticle deposit comprising the steps of:

providing a working liquid, movement of the working liquid at a liquid surface prevented by surface tension;

supplying an electric charge having a first polarity over a first time period to the working liquid at the liquid surface to overcome surface tension at the liquid surface to produce a first plurality of charged nanodrops;

directing the first plurality of charged nanodrops against a substrate;

supplying an electric charge having a second polarity over a second time period to the working liquid at the liquid surface, the second polarity being opposite to the first polarity, to overcome surface tension at the liquid surface to produce a second plurality of charged nanodrops;

directing the second plurality of charged nanodrops against the substrate;

alternating between supplying the electric charge having the first polarity and supplying the electric charge having the second polarity to the working liquid at the liquid surface; and varying the first time period independently from the second time period to control the momentum of the nanodrops arriving at the substrate surface.

2. The method according to claim 1, wherein the step of supplying the electric charge having the first polarity to the working liquid comprises the steps of:

providing an electrode disposed within the working liquid adjacent to the liquid surface; and supplying a charge having a first polarity to the electrode.

3. The method according to claim 1, wherein the step of supplying the electric charge having the second polarity to the working liquid comprises the steps of:

providing an electrode disposed within the working liquid adjacent to the liquid surface; and supplying a charge having a second polarity to the electrode.

* * * * *